US008002391B2

(12) United States Patent
Lee et al.

(10) Patent No.: US 8,002,391 B2
(45) Date of Patent: Aug. 23, 2011

(54) INKJET PRINTHEAD HAVING PIEZOELECTRIC ACTUATOR AND METHOD OF DRIVING THE PIEZOELECTRIC ACTUATOR

(75) Inventors: Hwa-sun Lee, Suwon-si (KR); Kyo-yeol Lee, Yongin-si (KR); Tae-kyung Lee, Suwon-si (KR); Chang-youl Moon, Suwon-si (KR); Jae-woo Chung, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 12/755,474

(22) Filed: Apr. 7, 2010

(65) Prior Publication Data

US 2010/0194828 A1 Aug. 5, 2010

Related U.S. Application Data

(62) Division of application No. 11/475,141, filed on Jun. 27, 2006, now Pat. No. 7,722,166.

(30) Foreign Application Priority Data

Jan. 21, 2006 (KR) ..... 2006-6583

(51) Int. Cl.
*B41J 2/045* (2006.01)

(52) U.S. Cl. ..... 347/72

(58) Field of Classification Search ..... 347/68, 347/70–72

See application file for complete search history.

(56) References Cited

U.S. PATENT DOCUMENTS

| | | | | |
|---|---|---|---|---|
| 4,520,374 | A | 5/1985 | Koto | |
| 5,589,898 | A | 12/1996 | Atkinson | |
| 5,983,471 | A * | 11/1999 | Osawa | 29/25.35 |
| 6,309,117 | B1 | 10/2001 | Bunce et al. | |
| 2003/0095705 | A1 | 5/2003 | Weast | |
| 2003/0133076 | A1 | 7/2003 | Lehmeier et al. | |
| 2004/0046838 | A1 | 3/2004 | Junhua | |
| 2004/0246313 | A1 | 12/2004 | Lim et al. | |
| 2005/0190232 | A1 | 9/2005 | Lee et al. | |
| 2005/0270340 | A1 | 12/2005 | Mita | |

FOREIGN PATENT DOCUMENTS

| | | |
|---|---|---|
| EP | 1354550 | 10/2003 |
| JP | 06-320723 | 11/1994 |
| JP | 11-157065 | 6/1999 |
| JP | 2002-059544 | 2/2002 |
| JP | 2002-219804 | 8/2002 |

(Continued)

OTHER PUBLICATIONS

Mieno H et al.: "Automatic Dyschromatopsia Test" Visual Computer, Springer, Berlin, DE, vol. 2, No. 2, Jan. 1989, pp. 97-101, XP002017404 ISSN: 0178-2789 Sections 4.1, 4.2.

(Continued)

*Primary Examiner* — An H Do
(74) *Attorney, Agent, or Firm* — Stanzione & Kim, LLP

(57) ABSTRACT

An inkjet printhead and a method of driving the inkjet printhead include a flow channel substrate having a pressure chamber, and a piezoelectric actuator formed on the flow channel substrate to apply a driving force to the pressure chamber to eject ink. The piezoelectric actuator includes a piezoelectric layer formed on the flow channel substrate to correspond to the pressure chamber, and a plurality of common electrodes and a plurality of driving electrodes alternately arranged in a length direction of the piezoelectric layer.

3 Claims, 4 Drawing Sheets

FOREIGN PATENT DOCUMENTS

| | | |
|---|---|---|
| JP | 2004-066496 | 3/2004 |
| JP | 2004-136461 | 5/2004 |
| JP | 2004-284363 | 10/2004 |
| JP | 2004-330724 | 11/2004 |
| JP | 2005-022165 | 1/2005 |
| JP | 2005-238846 | 9/2005 |
| JP | 2006-272664 | 10/2006 |
| WO | WO 2004073512 | 9/2004 |

OTHER PUBLICATIONS

Japanese Trial Bureau Decision issued Aug. 3, 2010 in JP Application No. 2006-343787.

Japanese Office Action issued Mar. 22, 2011 in JP Application No. 2006-343787.

Korean Office Action dated Dec. 6, 2006 issued in KR 2006-6583.

European Search Report dated Jul. 9, 2007 issued in EP 6251952.

Japanese Office Action issued Dec. 19, 2008 in Japan Application No. 2006-343787.

Japanese Office Action issued Aug. 26, 2009 in JP Application No. 2006-343787.

European Search Report issued Aug. 29, 2006 in EP Application No. 06113730.3.

Japanese Office Action issued Oct. 6, 2009 in JP Application No. 2006-343787.

* cited by examiner

INKJET PRINTHEAD HAVING PIEZOELECTRIC ACTUATOR AND METHOD OF DRIVING THE PIEZOELECTRIC ACTUATOR

CROSS-REFERENCE TO RELATED APPLICATIONS

This application is a divisional of prior application Ser. No. 11/475,141, filed on Jun. 27, 2006 and issued as U.S. Pat. No. 7,722,166 on May 25, 2010, in the U.S. Patent and Trademark Office, which claims benefit under 35 U.S.C. §119(a) of Korean Patent Application No. 10-2006-0006583, filed on Jan. 21, 2006, in the Korean Intellectual Property Office, the disclosures of which is incorporated herein in its entirety by reference.

BACKGROUND OF THE INVENTION

1. Field of the Invention

The present general inventive concept relates to an inkjet printhead that ejects ink using a piezoelectric actuator, and a method of driving the piezoelectric actuator of the inkjet printhead.

2. Description of the Related Art

Generally, inkjet printheads are devices for printing an image on a printing medium by ejecting droplets of ink onto a desired region of the printing medium. Depending on an ink ejecting method, the inkjet printheads can be classified as a thermal inkjet printhead and a piezoelectric inkjet printhead. In the thermal inkjet printhead, ink is heated to form ink bubbles, and an expansive force of the bubbles causes ink droplets to be ejected. In the piezoelectric inkjet printhead, a piezoelectric crystal is deformed, and a pressure due to the deformation of the piezoelectric crystal causes ink droplets to be ejected.

FIG. 1 is a vertical section illustrating a conventional piezoelectric inkjet printhead. Referring to FIG. 1, the conventional piezoelectric inkjet printhead includes a flow channel substrate 10 and a nozzle substrate 20 to form a manifold 13, a plurality of restrictors 12, and a plurality of pressure chambers 11 as an ink flow channel. A plurality of nozzles 22 corresponding to the pressure chambers 11 is formed in the nozzle substrate 20. A piezoelectric actuator 40 is formed on the flow channel substrate 10. The manifold 13 is a passage allowing an inflow of ink from an ink reservoir (not shown) to the pressure chambers 11, and the restrictors 12 is a passage allowing and/or restricting the inflow of the ink from the manifold 13 to the pressure chambers 11. The pressure chambers 11 are arranged along one side or both sides of the manifold 13 to store ink to be ejected through the nozzles 22. A volume of the pressure chamber 11 varies according to an operation of the piezoelectric actuator 40. Thus, ink flows into or out of the pressure chamber 11 according to the pressure variation. A portion of the flow channel substrate 10, such as an upper wall thereof to define the press chamber 11 with the nozzle substrate 20, is used as a vibrating plate 14 to control the ink to flow in or out of the pressure chamber 11. The vibrating plate 14 is deformed by the operation of the piezoelectric actuator 40.

The piezoelectric actuator 40 includes a lower electrode 41, a piezoelectric layer 42, and an upper electrode 43 that are sequentially stacked on the flow channel substrate 10. A silicon oxide layer 31 is formed between the lower electrode 41 and the flow channel substrate 10 as an insulating layer. The lower electrode 41 is formed on the entire surface of the silicon oxide layer 31 as a common electrode. The piezoelectric layer 42 is formed on the lower electrode 41 above the pressure chamber 11. The upper electrode 43 is formed on the piezoelectric layer 42 as a driving electrode for applying a voltage to the piezoelectric layer 42. A flexible printed circuit (FPC) is connected to the upper electrode 43 for applying a voltage to the upper electrode 43.

When a driving pulse is applied to the upper electrode 43, the piezoelectric layer 42 is deformed, thereby bending the vibrating plate 14 and thus changing the volume of the pressure chamber 11. Ink contained in the pressure chamber 11 is ejected through the nozzle 22 according to the changed volume of the pressure chamber. The deformation of the vibrating plate 14 should be large enough to effectively eject ink having various viscosities. The deformation of the vibrating plate 14 depends on a deformation amount of the piezoelectric layer 42 in a transverse direction. The transverse deformation of the piezoelectric layer 42 depends on a transverse length of the piezoelectric layer 42 and a magnitude of the driving voltage applied to the piezoelectric layer 42. However, the transverse length of the piezoelectric layer 42 is restricted by a length of the pressure chamber 11 in a direction of the traverse direction. Therefore, in the piezoelectric actuator 40 shown in FIG. 1, the driving voltage to the piezoelectric layer 42 should be large enough to increase the deformation of the vibrating plate 14. Further, the transverse deformation of the piezoelectric layer 42 depends on a thickness uniformity of the piezoelectric layer 42. That is, if a thickness of the piezoelectric layer 42 is not uniform, the transverse deformation of the piezoelectric layer 42 is affected by a thickness variation thereof.

SUMMARY OF THE INVENTION

The present general inventive concept provides a piezoelectric inkjet printhead that operates using a low driving voltage and is less affected by a thickness uniformity of a piezoelectric layer, and a method of driving the piezoelectric inkjet printhead.

Additional aspects and advantages of the present general inventive concept will be set forth in part in the description which follows and, in part, will be obvious from the description, or may be learned by practice of the general inventive concept.

The foregoing and/or other aspects of the present inventive concept may be achieved by providing an inkjet printhead including a flow channel substrate having a pressure chamber, and a piezoelectric actuator formed on the flow channel substrate to apply a driving force to the pressure chamber to eject ink, the piezoelectric actuator having a piezoelectric layer formed on the flow channel substrate in correspondence with the pressure chamber, and a plurality of common electrodes and a plurality of driving electrodes alternately arranged in a length direction of the piezoelectric layer.

The inkjet printhead may further include an insulating layer formed between the flow channel substrate and the piezoelectric actuator.

The common electrodes and the driving electrodes may be formed on the piezoelectric layer.

The foregoing and/or other aspects of the present inventive concept may also be achieved by providing a method of driving a piezoelectric actuator of an inkjet printhead including a flow channel substrate having a pressure chamber, the piezoelectric actuator formed on the flow channel substrate to apply a driving force to the pressure chamber to eject ink, the method including dividing a piezoelectric layer of the piezoelectric actuator into a plurality of sections in a length direction of the piezoelectric layer, and applying a driving electric field to each of the sections in the length direction.

The foregoing and/or other aspects of the present inventive concept may also be achieved by providing an inkjet printhead usable with an image forming apparatus, the inkjet printhead comprising a flow channel substrate including a pressure chamber to contain ink, and a piezoelectric actuator having a piezoelectric layer formed on the flow channel substrate to correspond to the pressure chamber, a common electrode having one or more end common electrodes to be spaced-apart from each other, and a driving electrode having one or more end driving electrodes to be spaced-apart from each other and to be disposed between the adjacent end common electrodes.

The foregoing and/or other aspects of the present inventive concept may also be achieved by providing an image forming apparatus comprising an inkjet printhead comprising a flow channel substrate including a pressure chamber to contain ink, and a piezoelectric actuator having a piezoelectric layer formed on the flow channel substrate to correspond to the pressure chamber, a common electrode having one or more end common electrodes to be spaced-apart from each other, and a driving electrode having one or more end driving electrodes to be spaced-apart from each other and to be disposed between the adjacent end common electrodes.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
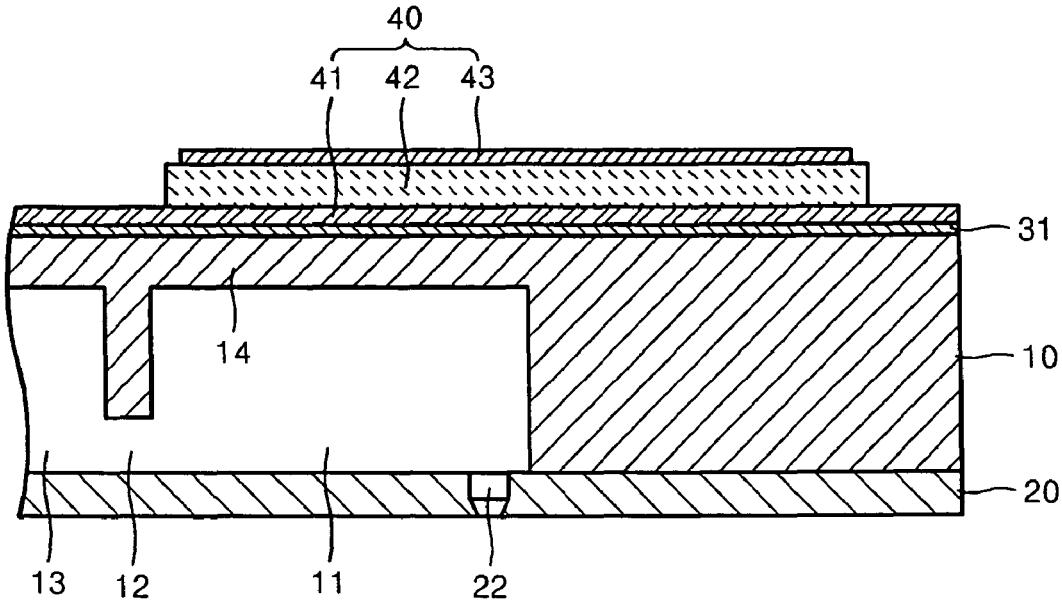
FIG. 1 (PRIOR ART)
FIG. 1 is a vertical cross-sectional view illustrating a conventional piezoelectric inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
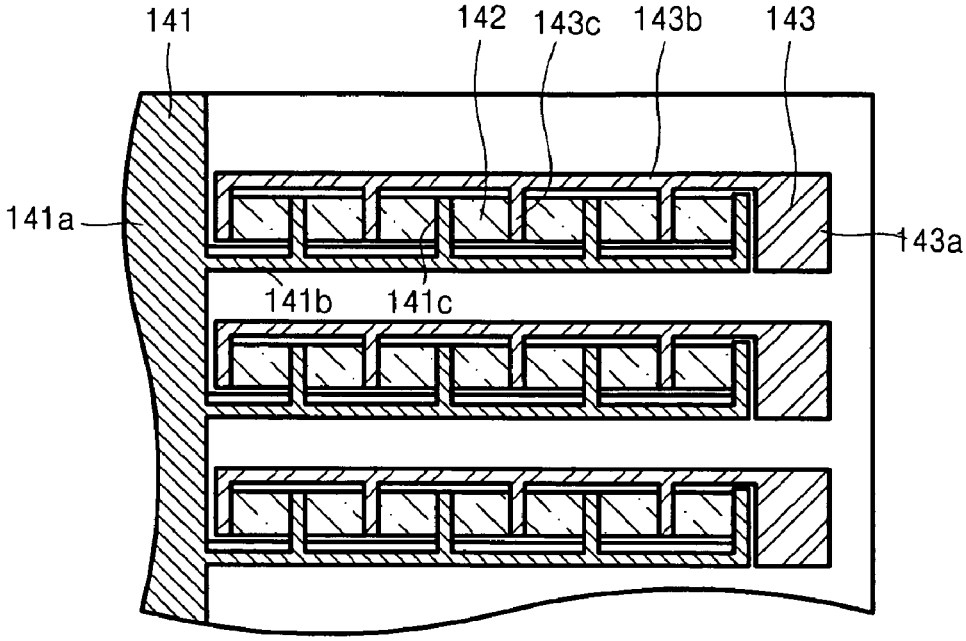
FIG. 2 is a plan view illustrating an inkjet printhead according to an embodiment of the present general inventive concept.
Figure 3:
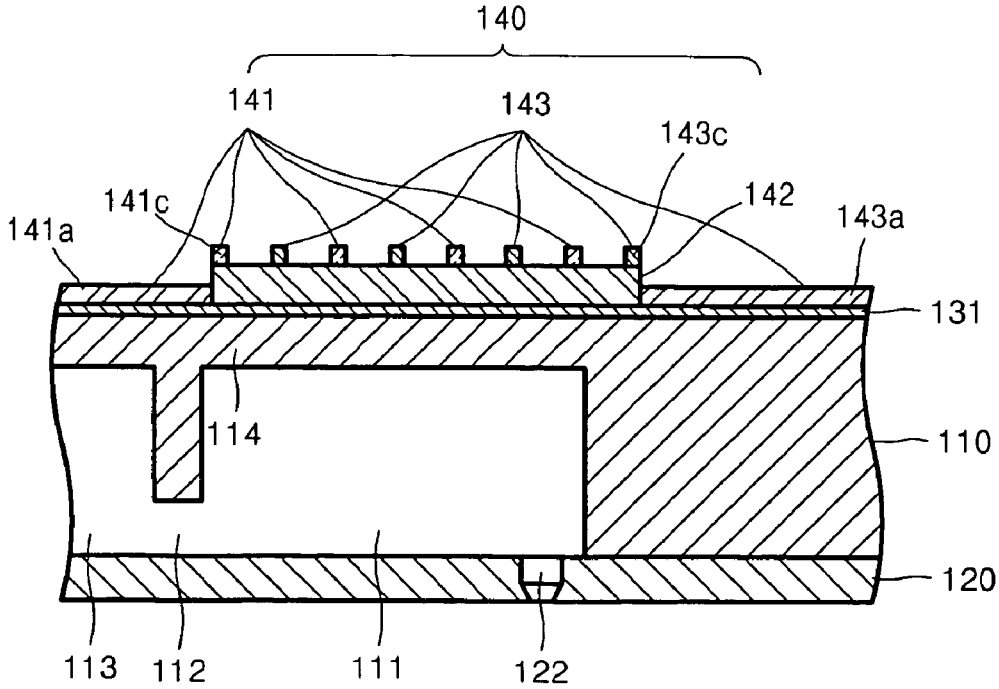
FIG. 3 is a vertical cross-sectional view illustrating of the inkjet printhead of FIG. 2.

FIG. 2 is a plan view illustrating a piezoelectric inkjet printhead usable in an image forming apparatus according to an embodiment of the present general inventive concept, and FIG. 3 is a vertical cross-sectional view illustrating the piezoelectric inkjet printhead of FIG. 2 along a length direction of a piezoelectric layer of the piezoelectric inkjet printhead.

Referring to FIGS. 2 and 3, the piezoelectric inkjet printhead includes a flow channel substrate 110 in which an ink flow channel is formed, and a piezoelectric actuator 140 providing an ink ejecting pressure. The flow channel substrate 110 includes a pressure chamber 111, a manifold 113 to supply ink to the pressure chamber 111, and a restrictor 112 to restrict an inflow of the ink from the manifold 113 to the pressure chamber 111. A nozzle substrate 120 is bonded to a bottom surface of the flow channel substrate 110 and includes a nozzle 122 to eject the ink contained in the pressure chamber 111. A vibrating plate 114 is formed on a portion of the flow channel substrate 110 corresponding to a top area of the pressure chamber 111, is deformed by the operation of the piezoelectric actuator 140. An ink flow channel is defined by the flow channel substrate 110 and the nozzle substrate 120, and is formed with the pressure chamber 111, the manifold 113, and the restrictor 112.

The piezoelectric actuator 140 is formed on the flow channel substrate 110 to apply a driving force to the pressure chamber 111 to eject ink. The piezoelectric actuator 140 includes a common electrode 141, a piezoelectric layer 142 deformable in response to an applied voltage, and a driving electrode 143 to receive a driving voltage corresponding to the applied voltage. The vibrating plate 114 is deformable according to the deformation of the piezoelectric layer 142. The common electrode 141, the piezoelectric layer 142, and the driving electrode 143 are stacked on the flow channel substrate 110. The driving electrode 143 may be connected to an external power source or a circuit to receive the driving voltage and to generate the applied voltage to the piezoelectric layer 142 with the common electrode 141.

If the flow channel substrate 110 is formed of a silicon wafer, an insulating layer 131 may be formed between the piezoelectric actuator 140 and the flow channel substrate 110. For example, the insulating layer 131 may be a silicon oxide layer formed on the flow channel substrate 110 by plasma enhanced chemical vapor deposition (PECVD).

The piezoelectric layer 142 is formed by screen-printing a piezoelectric material (paste) onto the insulating layer 131 by a predetermined thickness. The piezoelectric layer 142 is formed on a region corresponding to the pressure chamber 111. Although various piezoelectric materials can be used for the piezoelectric layer 142, PZT (lead zirconate titanate) ceramic may be used for the piezoelectric layer 142.

In the piezoelectric inkjet printhead of the present embodiment, the piezoelectric layer 142 is divided into a plurality of sections in a length direction thereof, and a driving electric field is applied to each of the sections. Referring to FIG. 2, electrodes of the common electrode 141 and the driving electrode 143 are alternately arranged along the length direction of the piezoelectric layer 142 to corresponding to the respective sections of the piezoelectric layer 142. Each section is defined by the adjacent ones of electrodes of the common electrode 141 and the driving electrode 143.

The common electrode 141 may include a main common electrode 141*a*, one or more middle common electrodes 141*b*, and a plurality of end common electrodes 141*c*. The main common electrode 141*a* is formed on the flow channel substrate 110 in a direction perpendicular to the longitudinal direction of the piezoelectric layer 142. Each middle common electrode 141*b* may be formed on one of the piezoelectric layer 142 and the flow channel substrate 110, connected to the main common electrode 141*a*, and extended from the main common electrode 141*a* along the longitudinal direction of the piezoelectric layer 142. The end common electrodes 141*c* are formed on the piezoelectric layer 142, connected to corresponding portions of the middle common electrode 141*b*, and extended in a direction perpendicular to the longitudinal direction of the piezoelectric layer 142. The end common electrodes 141*c* may be called as the common electrodes 141.

The driving electrode 143 may include a main driving electrode 143*a*, a middle driving electrode 143*b*, and end driving electrodes 143*c*. The main driving electrode 143*a* is formed on the flow channel substrate 110 in the paper feeding direction of the sheet of paper to be printed in the image forming apparatus. The middle driving electrode 143*b* is extended from the main driving electrode 141*a* along the longitudinal direction of the piezoelectric layer 142, for example, in the traverse direction perpendicular to the paper feeding direction. The end driving electrodes 143*c* are connected to corresponding portions of the middle driving electrode 143*b* and extended in the direction perpendicular to the longitudinal direction of the piezoelectric layer 142, for example, in the paper feeding direction of the sheet of paper. The end driving electrodes 143*c* may be called as the driving electrodes 143.

The main common electrode 141*a*, the middle common electrode 141*b*, and the end common electrodes 141*c* are spaced-apart from and parallel to the main driving electrode 143*a*, the middle driving electrode 143*b*, and the end driving electrodes 143*c*, respectively. The end common electrodes 141*a* and the end driving electrodes 143*c* may be alternatively disposed along the longitudinal direction of the piezoelectric layer 142. That is, one of the end common electrodes 141*a* is disposed between the adjacent end driving electrodes 143*c*, and one of the end driving electrodes 14*a* is disposed between the adjacent end common electrodes 141*c*.

The common electrodes 141 and the driving electrodes 143 are formed of conductive metals. The common electrodes 141 and the driving electrodes 143 may be formed by one metal layer or two metal layers such as a titanium (Ti) layer and a platinum (Pt) layer. The common electrodes 141 and the driving electrodes 143 may be formed by respectively depositing Ti and Pt onto the insulating layer 131 and the piezoelectric layer 142 using a sputtering process. Alternatively, the common electrodes 141 and the driving electrodes 143 may be formed by screen-printing a conductive metal such as Ag—Pd paste onto the piezoelectric layer 142. In this case, the piezoelectric layer 142, the common electrodes 141, and the driving electrodes 143 are sintered at a predetermined temperature, for example, 900 to 1,000° C. After that, a polling process is performed on the piezoelectric layer 142 by applying an electric field to the piezoelectric layer 142 to activate piezoelectric characteristic of the piezoelectric layer 142. The common electrodes 141 and the driving electrodes 143 may be formed between the piezoelectric layer 142 and the insulating layer 131.

Figure 4:
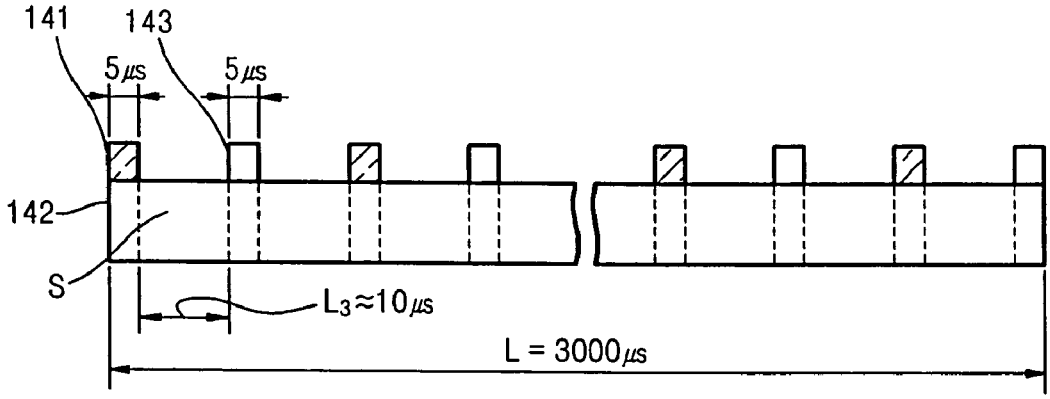
FIG. 4 is a vertical cross-sectional view illustrating an operation of the inkjet printhead of FIG. 2.

FIG. 4 is a view illustrating an example of how to calculate the deformation amount of the piezoelectric layer 142 when the piezoelectric actuator 140 according to an embodiment of the present general inventive concept. Referring to FIG. 4, one hundred common electrodes 141 and one hundred driving electrodes 143 are arranged in the length direction of the piezoelectric layer 142. Here, one hundred common electrodes 141 and one hundred driving electrodes 143 may be one hundred end common electrodes 141*c* and one hundred end driving electrodes 143*c*. In this case, the piezoelectric layer 142 is divided into one hundred and ninety nine sections (S) by the one hundred common electrodes 141 and the one hundred driving electrodes 143. When the length of the piezoelectric inkjet printhead layer 142 is 3000 μm, and widths of the common electrodes 141 and the driving electrodes 143 can be about 5 μm, a length of each section (S) can be approximately 10.05 μm (hereinafter, assumed to be 10 μm). Therefore, a total effective length of the piezoelectric layer 142 is 1990 μm (199×10 μm). When an electric field is formed at the respective sections (S) by a driving voltage applied to the driving electrodes 143, the piezoelectric layer 142 is elongated in the same length direction as a polarization direction of the piezoelectric layer 142. A length variation rate (Lr) of the piezoelectric layer 142 in the polarization direction can be expressed by the following equation:

$$Lr = d_{33} \times E_3$$
$$= d_{33} \times V_3 / L_3$$

where $d_{33}$ denotes a longitudinal piezoelectric coefficient in a length direction (the same as the polarization direction), $E_3$ denotes the strength of an electric field, $V_3$ denotes a voltage applied to the driving electrodes 143, and $L_3$ denotes the length of the section (S).

The longitudinal piezoelectric coefficient $d_{33}$ is two times higher than a transversal piezoelectric coefficient $d_{31}$ in a transverse direction (perpendicular to the polarization direction). Therefore, the length variation rate (Lr) of the piezoelectric layer 142 in the polarization direction can be expressed by the following equation:

$$Lr = -2 \times d_{31} \times V_3 / L_3$$

For example, when $d_{31} = -100 \times 10^{-12}$ m/V (the negative sign (−) means a decrease in the length of the piezoelectric layer 142), $V_3$=65 V, and $L_3$=10 μm, the length variation rate (Lr) is 1300 μm/m. By multiplying the length variation rate (Lr) of 1300 μm/m by 1990 μm (the total effective length of the piezoelectric layer 142), a total length variation value of the piezoelectric layer 142 is 2.587 μm=2587 nm. Consequently, when the piezoelectric layer 142 having a length of 3000 μm is divided into one hundred and ninety nine 10-μm sections (S) by the common electrodes 141 having a width of 5 μm and the driving electrodes 143 having a width of 5 μm, the total length variation value of the piezoelectric layer 142 is 2587 nm.

A length variation value of the piezoelectric layer 42 of a conventional piezoelectric actuator 40 of FIG. 1 will now be calculated hereinafter. The piezoelectric layer 42 is polarized in its thickness direction, and elongated in the thickness direction when a driving voltage is applied to an upper electrode 43. Therefore, the piezoelectric layer 42 shrinks in a direction perpendicular to its thickness direction. When a thickness (T) of the piezoelectric layer 42 is 25 μm, a length (L) of the piezoelectric layer 42 is 3000 μm, and a voltage of 65 V is applied to the upper electrode 43, $$\text{The length variation value of the piezoelectric layer 42} = d_{31} \times E_3 \times L = (d_{31} \times V_3 / T) \times L = (-100 \times 10^{-12} \times 65 / 25 \times 10^{-6}) \times 3000 = -780 \text{ nm.}$$

That is, the length of the piezoelectric layer 42 decreases by 780 nm.

When the two results are compared, the deformation amount of the piezoelectric actuator 140 of the present embodiment is approximately 3.3 times greater than that of the conventional piezoelectric actuator 40. Although other parameters such as the thickness and length of the piezoelectric layer 142 and the magnitude of the driving voltage are not changed, the deformation amount of the piezoelectric actuator 140 of the present embodiment can be largely increased compared with the conventional piezoelectric actuator 40 by dividing the piezoelectric layer 142 into the plurality of sections (S) and applying the driving voltage to the respective sections (S). The above-described calculations show a difference between the deformation amounts of the conventional inkjet printhead of FIG. 1 and the inkjet printhead of FIG. 2 according to the present embodiment.

In FIG. 4, if the numbers of the common electrodes 141 and the driving electrodes 143 are n/2, respectively, the total length of the piezoelectric layer 142 is L, and the length of the respective sections (S) is $L_3$, the total effective length of the piezoelectric layer 142 is $(n-1)\times L_3$. Therefore, the length variation value of the piezoelectric layer 142 is as follows:

$$(-2\times d_{31}\times E_3)\times(n-1)\times L_3=(-2\times d_{31}\times V_3/L_3)\times(n-1)\times L_3$$
$$=-2\times d_{31}\times V_3\times(n-1)$$

That is, the length variation value of the piezoelectric layer 142 increases as the number of sections (S) increases (i.e., as the widths of the common electrodes 141 and the driving electrodes 143, and the length $L_3$ of the respective sections (S) become smaller). Therefore, according to the present invention, the piezoelectric actuator 140 of the piezoelectric inkjet printhead can be deformed much more than the conventional piezoelectric actuator when the size of the piezoelectric layer 142 and the driving voltage $V_3$ are the same as those of the conventional piezoelectric actuator. In calculating the deformation amount of the piezoelectric layer 42 of the conventional piezoelectric actuator 40, the piezoelectric coefficient $d_{31}$ is a transverse piezoelectric coefficient defined in a direction perpendicular to the polarization direction (the thickness direction of the piezoelectric layer 42). Therefore, the piezoelectric actuator 40 can be stably driven only when the thickness of the piezoelectric layer 42 is uniform.

However, according to the present invention, in calculating the deformation amount of the piezoelectric layer 142 of the piezoelectric actuator 140, the piezoelectric coefficient $d_{33}$ is a longitudinal piezoelectric coefficient defined in the same direction as the polarization direction (the length direction of the piezoelectric layer 142). Therefore, the deformation amount of the piezoelectric layer 142 is not largely affected by the thickness uniformity of the piezoelectric layer 142. That is, the piezoelectric actuator 140 can be uniformly deformed if the common electrodes 141 and the driving electrodes 143 are uniformly formed. As a result, the inkjet printhead of the present embodiment can print images with uniform quality.

Further, since the piezoelectric actuator 140 can be deformed to a desired degree with a much lower driving voltage by dividing the piezoelectric layer 142 into a plurality of sections, a low-voltage piezoelectric inkjet printhead can be provided.

Furthermore, in the conventional inkjet printhead having the lower and upper electrodes 41 and 43 on top and bottom surfaces of the piezoelectric layer 42 as illustrated in FIG. 1, the silicon oxide layer 31 is formed on the flow channel substrate 10, and the lower electrode 41 is formed on the silicon oxide layer 31. Next, the piezoelectric layer 42 is formed on the lower electrode 41. Then, the upper electrode 43 is formed on the piezoelectric layer 42. However, in the inkjet printhead of the present embodiment, a silicon oxide layer is formed on the flow channel substrate 110 as the insulating layer 131, and the piezoelectric layer 142 is formed on the insulating layer 131. Then, the common electrodes 141 and the driving electrodes 143 are simultaneously formed on the piezoelectric layer 142 and the insulating layer 131. Therefore, the electrodes 141 and 143 can be formed through a simple process with less cost when compared with the conventional inkjet printhead.

Figure 5A:
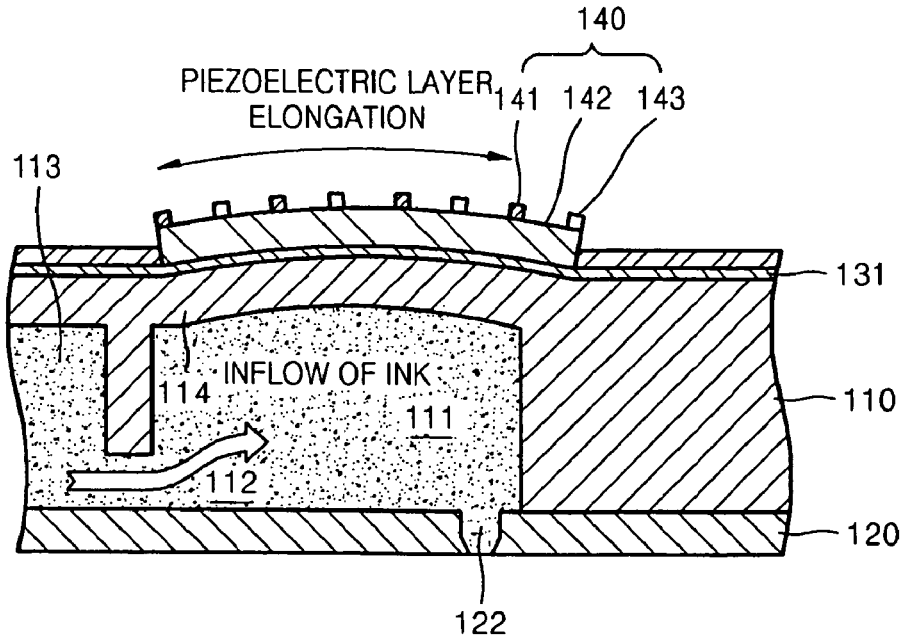
FIGS. 5A and 5B views illustrating an ink ejecting operation of the inkjet printhead of FIG. 2.
Figure 5B:
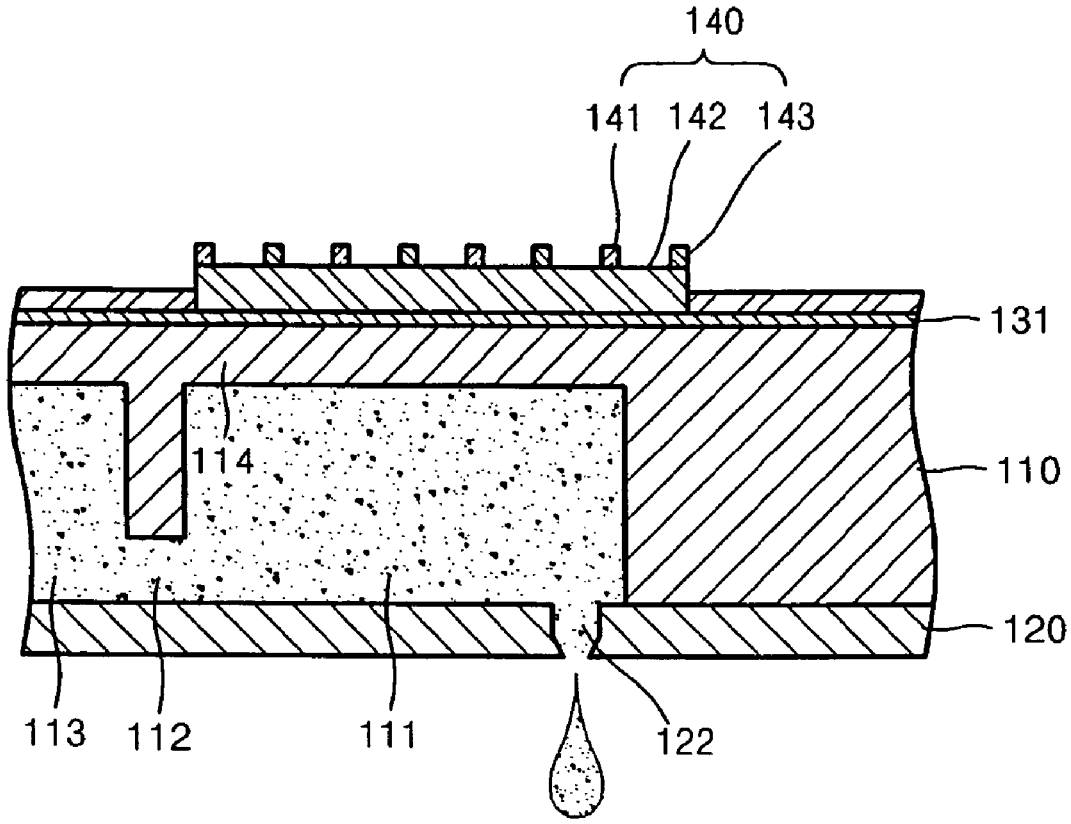

FIGS. 5A and 5B are views illustrating an ink ejecting operation of the inkjet printhead of FIG. 2. Referring to FIG. 5A, in the inkjet printhead of the present embodiment, when a driving voltage is applied to the driving electrodes 143, the piezoelectric layer 142 is elongated, thereby bending the vibrating plate 114 upward and therefore increasing the volume of the pressure chamber 111. Ink flows from an ink reservoir (not shown) into the pressure chamber 111 through the manifold 113 and the restrictor 112 according to the upward bending of the vibrating plate 114. Referring to FIG. 5B, when the driving voltage is removed from the driving electrodes 143, the piezoelectric layer 142 and the vibrating plate 114 return to their original shapes, and thus the volume of the pressure chamber 111 is reduced. By a pressure wave caused by the reduction of the volume of the pressure chamber 111, the ink contained in the pressure chamber 111 is ejected through the nozzle 122. Ink can be successively ejected through the nozzle 122 by applying a driving pulse voltage to the driving electrodes 143.

According to the embodiments of the present general inventive concept, the piezoelectric inkjet printhead and the method of driving the piezoelectric inkjet printhead have the piezoelectric layer 142 of the piezoelectric actuator 140 which is divided into a plurality of sections (S) along the length of the piezoelectric layer 142, and a driving electric field is applied to each of the sections (S) using the electrodes 141 and 143. The flow channel substrate 110 and the nozzle substrate 120 shown in FIGS. 2 and 3 are exemplary. That is, various other ink flow channels can be formed in the piezoelectric inkjet printhead of the present invention. Further, the ink flow channel can be formed using a number of substrates instead of using two substrates 110 and 120 shown in FIG. 3.

As described above, according to the embodiments of the present general inventive concept, the piezoelectric inkjet printhead and the method of driving the piezoelectric inkjet printhead have the following advantages.

First, since the piezoelectric layer is divided into a plurality of sections and a driving electric field is applied to each of the sections, the deformation amount of the piezoelectric layer of the piezoelectric actuator can be largely increased using the same piezoelectric layer and driving voltage, compared to the conventional piezoelectric actuator.

Secondly, the same deformation amount of the piezoelectric actuator can be obtained using a much lower driving voltage by dividing the piezoelectric layer into a plurality of sections. Therefore, a low-voltage piezoelectric inkjet printhead can be provided.

Thirdly, since the deformation amount of the piezoelectric layer is calculated using the longitudinal piezoelectric coefficient $d_{33}$ in the piezoelectric actuator of the inkjet printhead of the present invention, the deformation amount of deformation of the piezoelectric layer is less affected by the thickness of the piezoelectric layer.

Fourthly, the common electrodes and the driving electrodes can be simultaneously formed on the piezoelectric layer, so that a process of forming the electrodes can be simplified, and thus manufacturing cost can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead usable with an image forming apparatus, comprising:

a flow channel substrate including a pressure chamber to contain ink; and a piezoelectric actuator having a piezoelectric layer formed on the flow channel substrate to correspond to the pressure chamber, a common electrode having one or more end common electrodes to be spaced-apart from each other, and a driving electrode having one or more end driving electrodes to be spaced-apart from each other and to be disposed between the adjacent end common electrodes, wherein the one or more end common electrodes and the one or more end driving electrodes are disposed on a common surface of the piezoelectric layer.

2. The inkjet printhead of claim 1, wherein the piezoelectric layer is divided into a plurality of sections by the end common electrodes and the end driving electrodes in the longitudinal direction.

3. An image forming apparatus comprising:

an inkjet printhead comprising a flow channel substrate including a pressure chamber to contain ink, and a piezoelectric actuator having a piezoelectric layer formed on the flow channel substrate to correspond to the pressure chamber, a common electrode having one or more end common electrodes to be spaced-apart from each other, and a driving electrode having one or more end driving electrodes to be spaced-apart from each other and to be disposed between the adjacent end common electrodes, wherein the one or more end common electrodes and the one or more end driving electrodes are disposed on a common surface of the piezoelectric layer.

* * * * *